US006963723B2

(12) United States Patent
Baba

(10) Patent No.: US 6,963,723 B2
(45) Date of Patent: Nov. 8, 2005

(54) PRINTER WITH MEDIA TURNOVER GUIDE

(75) Inventor: Emiko Baba, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/634,482

(22) Filed: Aug. 5, 2003

(65) Prior Publication Data

US 2004/0086311 A1 May 6, 2004

(30) Foreign Application Priority Data

Aug. 19, 2002 (JP) ..... 2002-238277

(51) Int. Cl.[7] ..... G03G 15/00
(52) U.S. Cl. ..... 399/405
(58) Field of Search ..... 399/405, 107, 399/404, 16

(56) References Cited

U.S. PATENT DOCUMENTS 6,304,742 B1 * 10/2001 Nunes et al. ..... 399/361
6,487,382 B2 * 11/2002 Underwood et al. ..... 399/82

FOREIGN PATENT DOCUMENTS

JP 01048772 A * 2/1989 ..... B65H 29/70

* cited by examiner

*Primary Examiner*—Quana Grainger
(74) *Attorney, Agent, or Firm*—Akin Gump Strauss Hauer & Feld, LLP

(57) ABSTRACT

A printer has a main body, a back delivery unit, and a media turnover guide that is detachably or tiltably mounted on the main body. When mounted in an operable position, the media turnover guide delivers printed media face-down onto the top cover of the main body, where they can be easily retrieved. When the media turnover guide is mounted in an inoperable position or is detached, the printed media are delivered face-up to the back delivery unit. The media turnover guide may have a simple structure with a curved surface formed by a back wall and roof. The printer may also have a stacker for stacking the printed media delivered face-down.

21 Claims, 12 Drawing Sheets

PRINTER WITH MEDIA TURNOVER GUIDE

BACKGROUND OF THE INVENTION

1. Field of the Invention

The present invention relates to a printer with novel features for delivering and stacking printed pages.

2. Description of the Related Art

Printers designed for office use often have both a face-down mode, in which printed pages are delivered and stacked with the printed side facing down, and a face-up mode, in which printed pages are delivered and stacked with the printed side facing up. Many compact, low-cost printers designed for personal use, however, have only a face-up mode.

A conventional printer of the latter type is illustrated in FIG. 1. The main body 50 of the printer has a front panel 50*a* and a back panel 50*b*. A media rack 51 is attached to the main body 50 near the top of the back panel 50*b*. The media rack 51 is connected to a media feed-in guide 20 that slopes diagonally downward inside the main body 50, the media rack 51 and media feed-in guide 20 forming a media supply unit 54. Printing media (not shown) loaded into the media rack 51 pass through an inlet (In) at the junction between the media rack 51 and media feed-in guide 20 as indicated by arrow A, the front edge of the media thus coming into contact with a feed roller 52.

When printing starts, the feed roller 52 rotates to guide the media along a path indicated by arrow B, past an image-forming unit 53 and a fusing unit 56. The image-forming unit 53 transfers an image onto each media page, and the fusing unit 56 fuses the image onto the page.

A delivery unit 11 feeds out the printed media in the direction indicated by arrow C, with the printed side facing up. The delivered pages are stacked upright with their trailing edges resting on a delivery ledge 55, which is disposed just in front of the inlet (In).

A conventional printer of a different type has a media loader disposed below the front panel. The media are fed from the media loader through the image-forming unit and fusing unit. The printed media are fed out with the printed side facing up, and stacked upright with their trailing edges resting on a delivery ledge at the back of the printer.

Because these conventional printers stack the printed media face up at the back of the printer, the page order is reversed, which is inconvenient, and the operator has to reach across the printer to retrieve the printed media, which is also inconvenient.

SUMMARY OF THE INVENTION

An object of the present invention is to simplify the retrieval of printed media from a printer.

The invented printer has a main body, a back delivery unit for receiving printed media at the back of the main body, and a media turnover guide with a curved surface that guides printed media onto the top cover of the main body. The media turnover guide may be detachably or tiltably mounted on the main body. When the media turnover guide is mounted in an operable position, the printed media are delivered in the correct order toward the front of the printer, so the operator does not have to reach to the back of the printer to retrieve the printed media, or rearrange the page order.

DETAILED DESCRIPTION OF THE INVENTION

Figure 1:
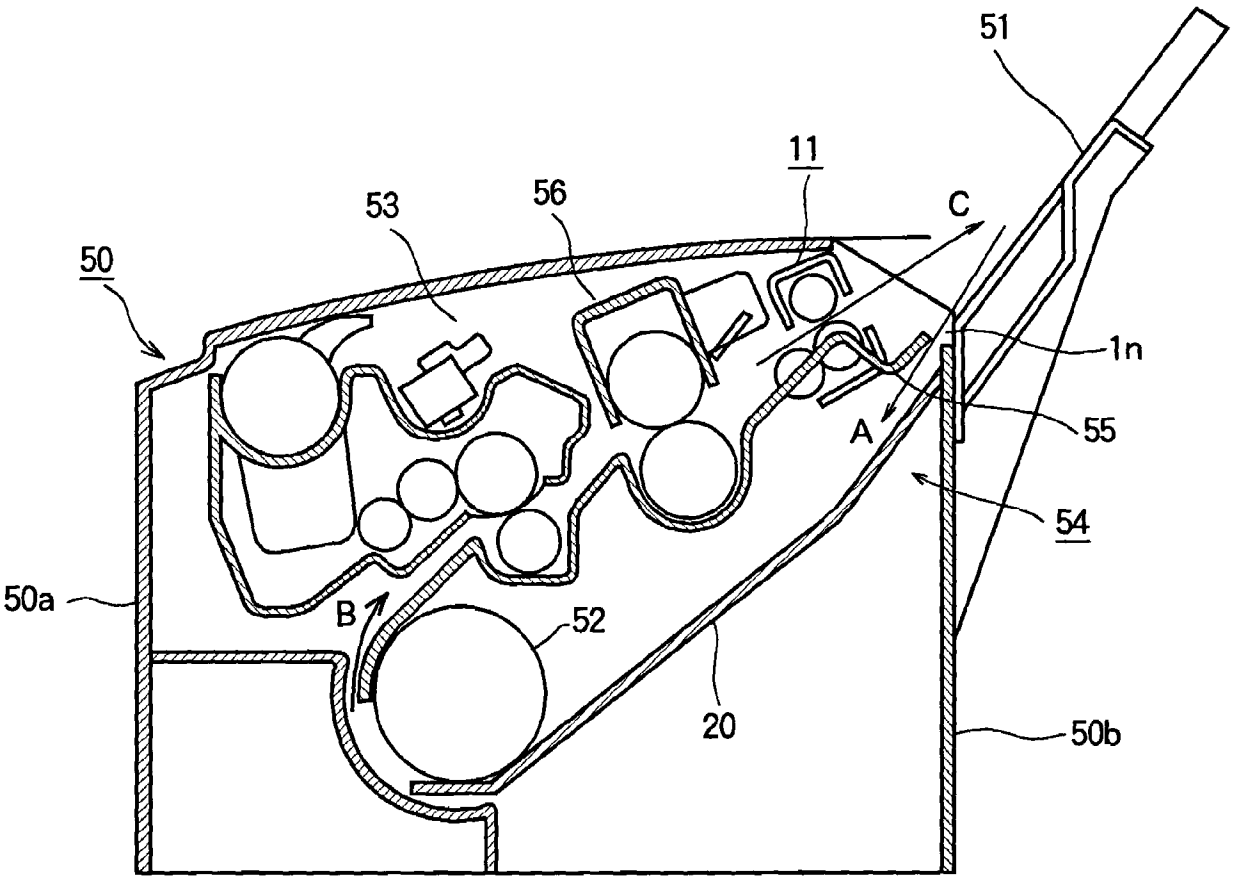
FIG.1 PRIOR ART
FIG. 1 is a side sectional view of a conventional printer.

Embodiments of the invention will now be described with reference to the attached drawings, in which like elements are indicated by like reference characters.

Figure 2:
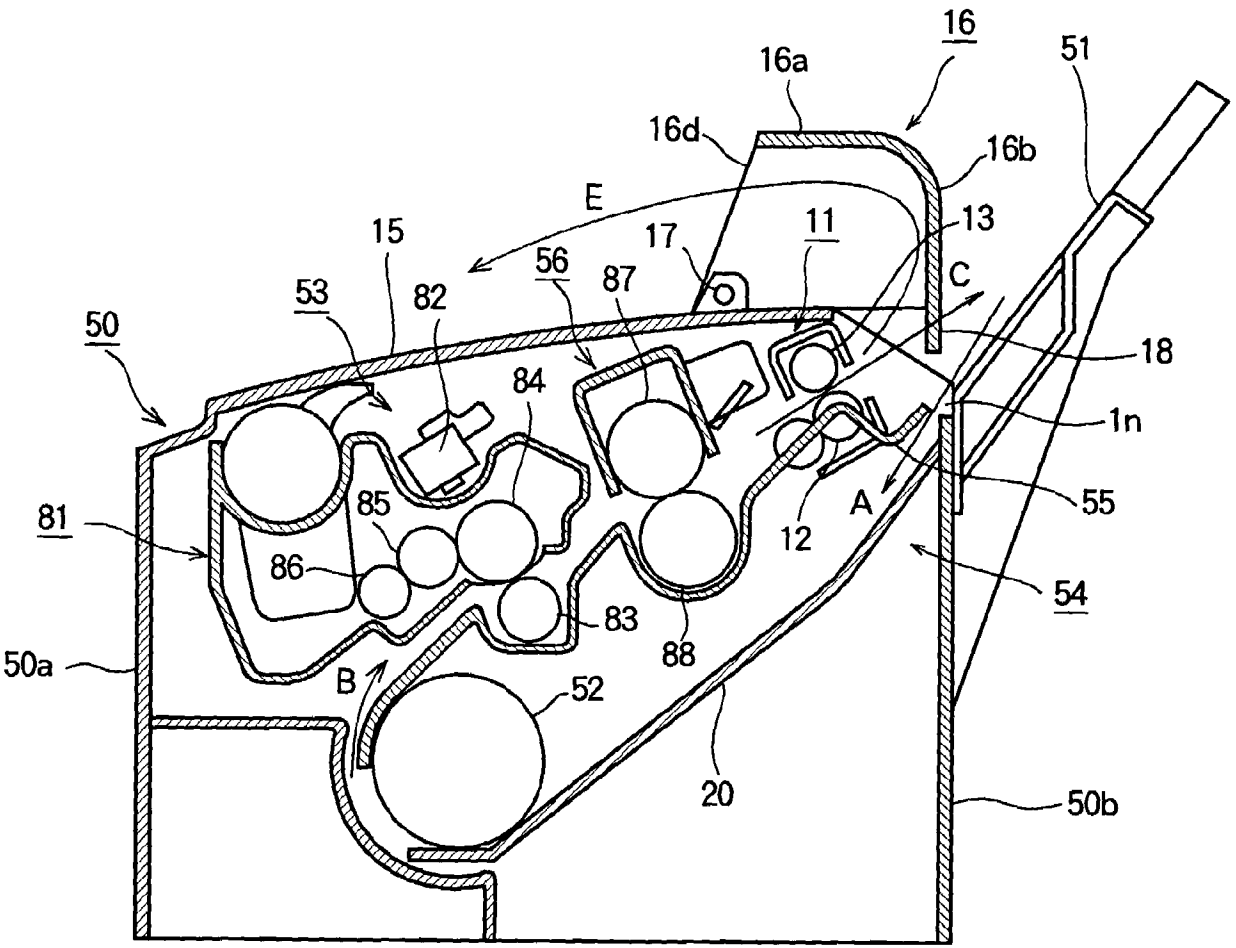
FIG. 2 is a side sectional view of a printer according to a first embodiment of the invention.
Figure 3:
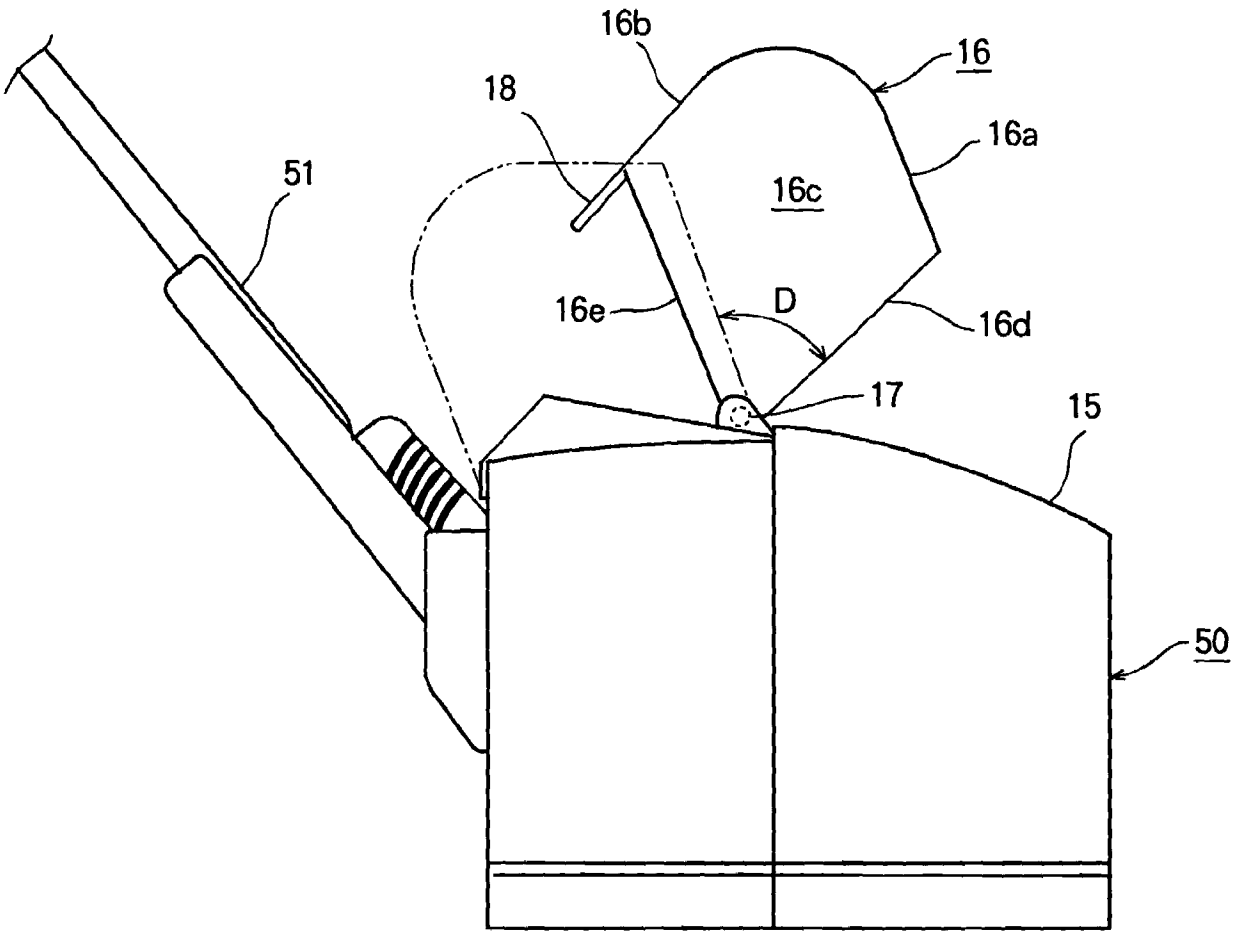
FIG. 3 is a side elevational view of the printer in FIG. 2.

In a first embodiment, illustrated in FIGS. 2 and 3, the printer has a main body 50 with a front panel 50*a*, a back panel 50*b*, and a top cover 15 that slopes gradually downward from back to front. A media rack 51 is mounted near the top of the back panel 50*b*, extending upward and backward therefrom. The media rack 51 is connected near the top of the back panel 50*b* to a media feed-in guide 20 that slopes diagonally downward inside the main body 50, the media rack 51 and media feed-in guide 20 forming a media supply unit 54. A feed roller 52 is rotatably mounted near the lower end of the media feed-in guide 20.

Sheets of paper or other printing media loaded into the media rack 51 enter the media feed-in guide 20 through an inlet (In) as indicated by arrow A and come to rest with their front edge against the feed roller 52. The media rack 51 also functions as a back delivery tray in which printed pages can be stacked.

When printing starts, the feed roller 52 is driven to guide the media along a path indicated by arrow B, past an image-forming unit 53 and a fusing unit 56. The image-forming unit 53 comprises an image development (ID) unit 81, a light-emitting-diode (LED) head 82, and a transfer roller 83. The image development unit 81 comprises a photosensitive drum 84, a developing roller 85, and a toner supply roller 86. The fusing unit 56 comprises a heat roller 87 and a pressure roller 88. The surface of the photosensitive drum 84 is uniformly charged by a charging roller (not shown), then exposed to light emitted by the LED head 82 to form an electrostatic image. The developing roller 85 develops the electrostatic image with toner, and the toner image is transferred onto media passing between the photosensitive drum 84 and transfer roller 83. The media then pass between the heat roller 87 and pressure roller 88, which fuse the transferred toner image onto the media by heat and pressure.

The printed pages are fed out of the main body 50 by a delivery unit 11 comprising a delivery roller 12 and a pinch roller 13. The pinch roller 13 presses the media against the delivery roller 12, which is rotationally driven to deliver the media in the direction of arrow C.

In order to provide both a face-down mode, in which printed pages are delivered and stacked with the printed side facing down, and a face-up mode, in which printed pages are delivered and stacked with the printed side facing up, the printer has a media turnover guide 16 disposed above the back edge of the top cover 15. The media turnover guide 16 has a hood-like shape and is attached to the top cover by pins 17 in such a way that it can be tilted to first and second positions, indicated respectively by the dot-dash line and the solid line in FIG. 3, the tilting motion being indicated by arrow D.

The media turnover guide 16 comprises a roof 16*a,* a back wall 16*b,* right and left side walls 16*c,* an exit opening 16*d* at the front (the left in FIG. 2, the right in FIG. 3), an entrance opening 16*e* at the bottom, and a projection 18 extending below the entrance opening 16*e* from the back wall 16*b*. The roof 16*a* and back wall 16*b* are smoothly joined to forming a curved surface.

After media are fed into the printer by the feed roller 52, printed on by the image-forming unit 53 and fusing unit 56, and fed out by the delivery unit 11, if the media turnover guide 16 is in the first position as shown in FIG. 2, the printed pages encounter the projection 18 and enter the media turnover guide 16 through its entrance opening 16*e*. Guided by the back wall 16*b* and roof 16*a,* the media are delivered from the exit opening 16*d* onto the top cover 15 of the printer in the direction indicated by arrow E, with the printed side facing down.

If the media turnover guide 16 is in the second position, the printed media are delivered in the direction indicated by arrow C, with the printed side facing up, and stacked upright in the media rack 51 with their trailing edges resting in a delivery ledge 55 just in front of the inlet (In) at a rear of the printer. The media rack 51 and delivery ledge 55 form a back delivery unit.

In the face-down mode, since the printed media are delivered onto the top cover 15, the operator can retrieve them without having to reach to the back of the printer, and the page order is not reversed. These advantages are obtained at a low cost, because the media are guided along the curved inside surface of the media turnover guide 16, without the need for rollers or other mechanical devices.

In a variation of the first embodiment, the media turnover guide is detachably mounted on the main body 50. The printed media are guided face-down onto the top cover 15 when the media turnover guide is mounted, and are stacked face-up in the media rack 51 when the media turnover guide is detached.

In the first embodiment, pages printed in the face-down mode are delivered onto the top cover 15 but cannot be stacked thereon.

Figure 4:
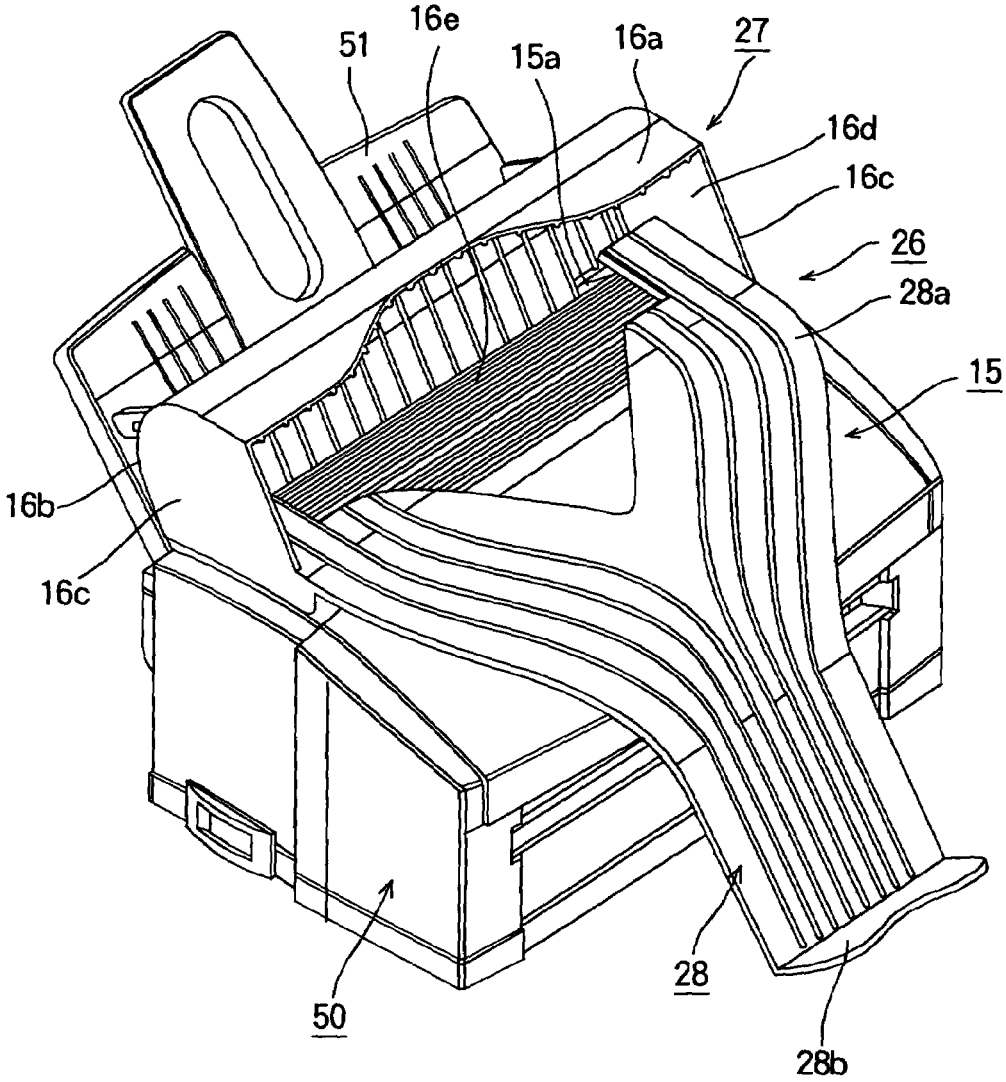
FIG. 4 is a perspective view of a printer according to a second embodiment of the invention.

A face-down stacking feature is provided in a second embodiment, illustrated in FIG. 4. The printer has a media turnover and stacking unit 26, which guides and receives the media delivered by the delivery unit 11. The media turnover and stacking unit 26 comprises a turnover guide 27 and a stacker 28; the stacker 28 comprises a media shelf 28*a* and a stopper 28*b*. The turnover guide 27 has the same structure as the media turnover guide 16 in the first embodiment, but is detachably mounted on the main body 50 by a fixture not shown in the drawing. The stacker 28, which receives the delivered media, extends forward from the turnover guide 27. The media shelf 28*a* is a Y-shaped plate with a curved shape that follows the curve of the top cover 15 and then extends further forward and downward. The two symmetrical ends of the Y are attached to the back edge 15*a* of the top cover 15. The stopper 28*b* is an upwardly bent member at the front edge of the media shelf 28*a* that prevents the printed media from slipping off.

When the media turnover and stacking unit 26 is mounted on the main body 50, the media fed out by the delivery unit 11 encounter the projection shown in FIG. 3 and enter the media turnover guide 27 through the entrance opening 16*e*. Guided by the back wall 16*b* and roof 16*a,* the media are delivered from the exit opening 16*d* and stacked in the stacker 28. When the media turnover and stacking unit 26 is not mounted on the main body 50, the printed media are stacked in the media rack 51.

The media turnover and stacking unit 26 of the second embodiment occupies a large area on the top cover 15, and greatly affects the appearance of the printer. Furthermore, when consumable articles in the main body 50 have to be replaced, the operator has to detach the media turnover and stacking unit 26 before opening the top cover 15. To avoid this inconvenience, the printer of a third embodiment, illustrated in FIGS. 5, 6, 7, 8, and 9, has a stacker under the main body 50.

Figure 5:
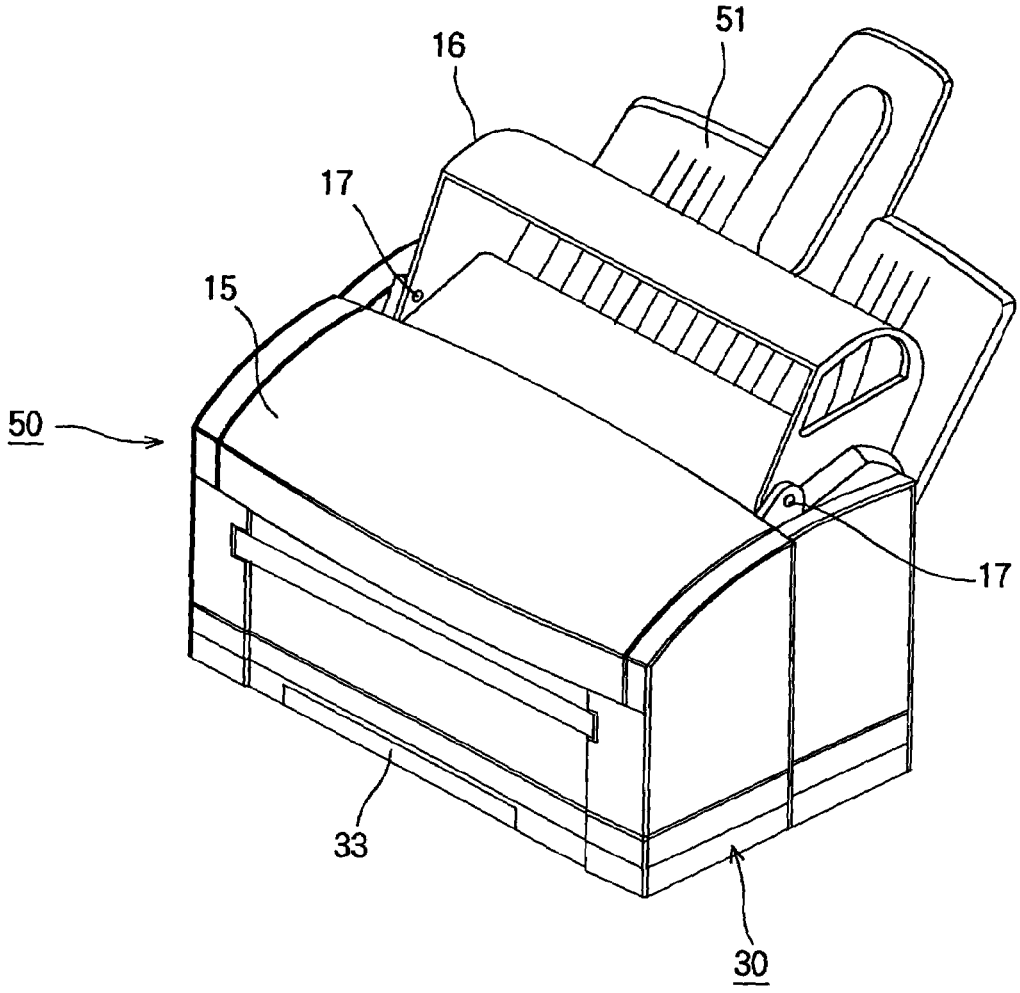
FIG. 5 is a perspective view of a printer according to a third embodiment of the invention.
Figure 6:
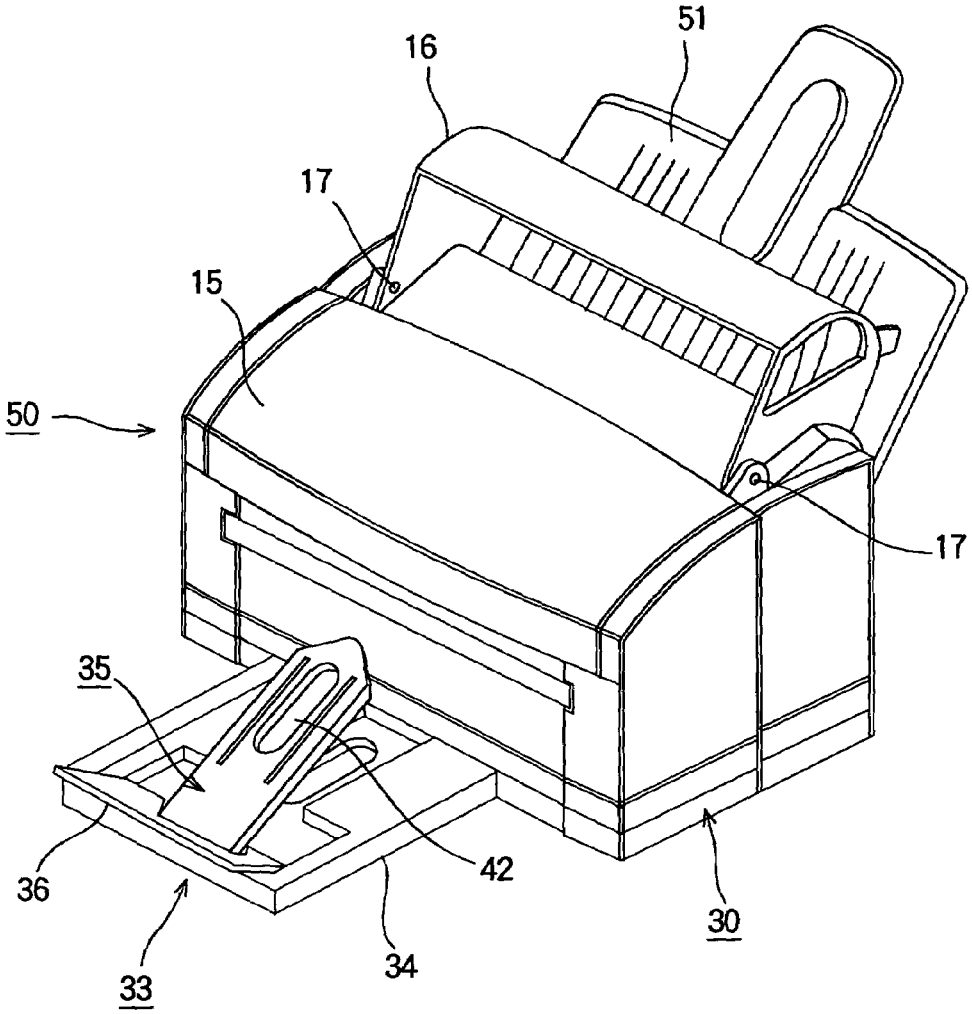
FIG. 6 is a perspective view of the printer in FIG. 5, with the stacker extended.
Figure 7:
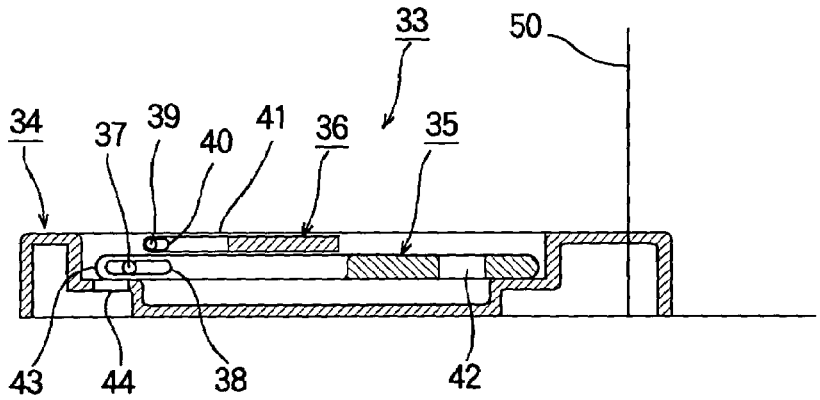
FIG. 7 is a sectional view of the stacker in FIG. 5, showing the non-erected state.
Figure 8:
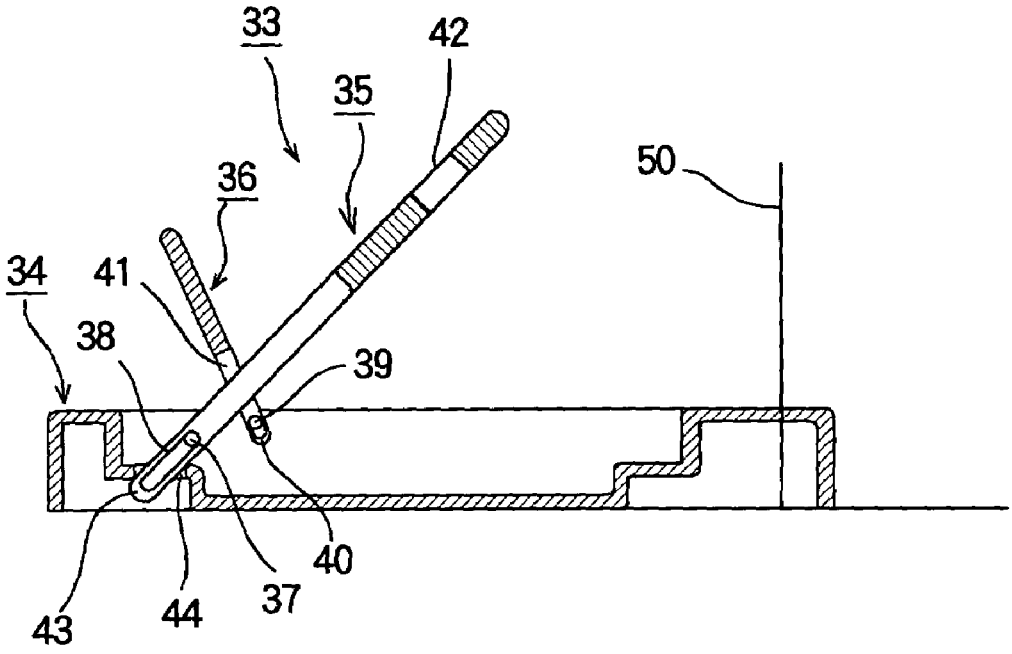
FIG. 8 is a sectional view of the stacker in FIG. 5, showing the erected state.

Referring to FIG. 5, this printer has a media turnover guide 16 of the type described in the first embodiment. A stacker housing 30 disposed below the main body 50 holds a withdrawable stacker 33. As shown in FIG. 6, the stacker 33 comprises a base plate 34, a first member that will be referred to as a media support 35, and a second member that will be referred to as a media stopper 36. Referring to FIGS. 7 and 8, the base plate 34 has first pins 37 that engage slots 38 on both sides of the media support 35, and second pins 39 that engage slots 40 on both sides of the media stopper 36. The media stopper 36 has a rectangular cut-out portion 41 that permits the media support 35 to be raised. To facilitate raising, the media support 35 has a finger slot 42 near its upper end and a locking rim 43 at its lower end, facing a rectangular slot 44 in the base plate 34.

To erect the stacker 33, the operator pulls the media support 35 by hooking his or her finger in the finger slot 42, thereby also lifting the media stopper 36. When the media support 35 has been raised to a certain angle, its locking rim 43 drops into the rectangular slot 44 in the base plate 34, and the media support 35 is held at this angle, while the media stopper 36 is held at substantially a right angle to the media support 35, as shown in FIG. 8.

Figure 9:
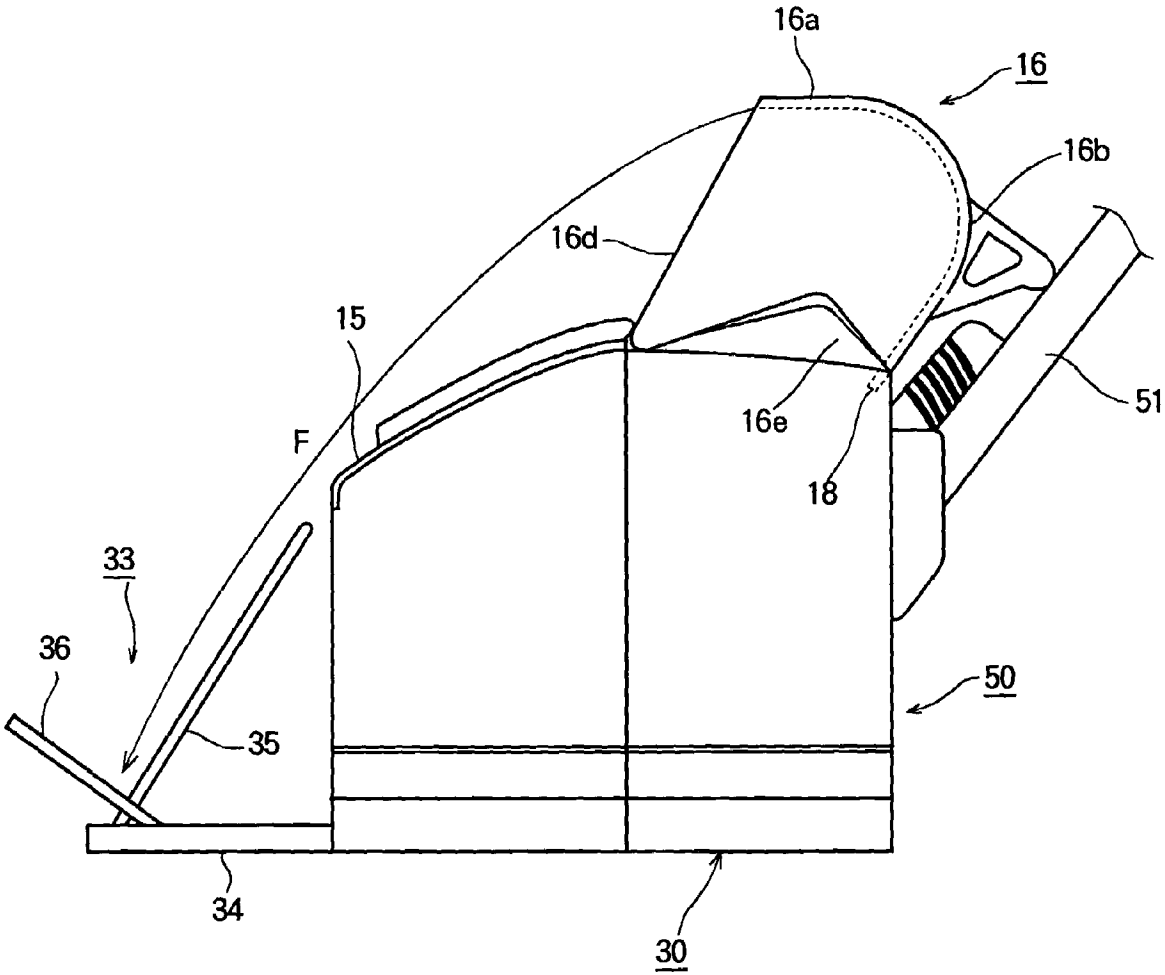
FIG. 9 is a side elevational view of the printer in FIG. 5, showing how the printed pages are delivered face-down.

When the media turnover guide 16 is in the first position, if the stacker 33 is withdrawn from the stacker housing 30 and the media support 35 and media stopper 36 are erected as described above, the surface of the media support 35 becomes an extension of the top cover 15 as shown in FIG. 9. Printed media fed out from the delivery unit 11 encounter the projection 18 and enter the media turnover guide 16 through the entrance opening 16*e*. Guided by the back wall 16*b* and roof 16*a,* the media are delivered from the exit opening 16*d* onto the top cover in the direction indicated by arrow F, with the printed side facing down. Since the media stopper 36 is erected at substantially a right angle to the media support 35, it functions as a stopper for the media delivered onto the media support 35.

The withdrawable stacker 33 in the stacker housing 30 provided under the main body 50 does not affect the appearance of the printer in the third embodiment, and consumable articles in the main body 50 can be easily replaced.

Figure 10:
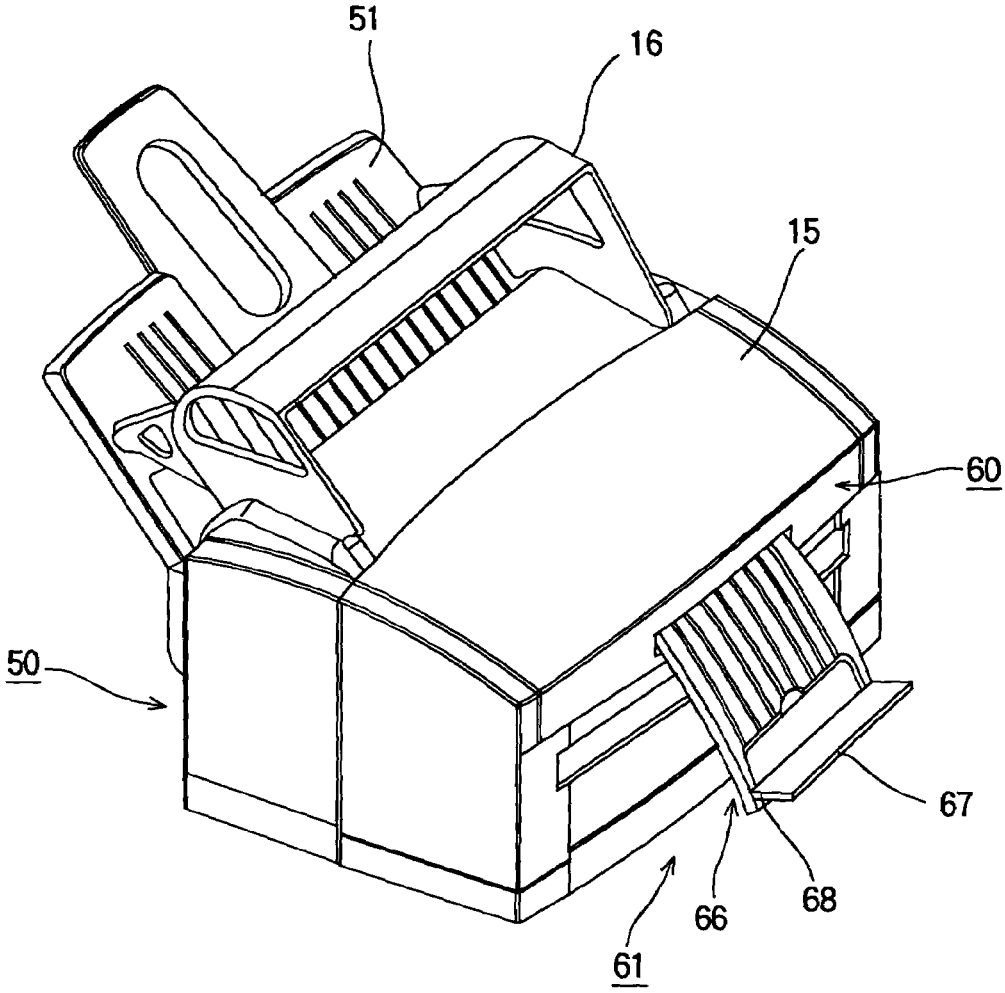
FIG. 10 is a perspective view of a printer according to a fourth embodiment of the invention.

In a fourth embodiment of the invention, illustrated in FIGS. 10 and 11, the stacker is housed below the top cover 15.

A stacker housing 60 holding a withdrawable stacker 61 is provided under the top cover 15. The stacker 61 comprises two members, these being a media shelf 66 and a media stopper 67, the media stopper 67 being tiltably attached to the media shelf 66 by pins 68.

Figure 11:
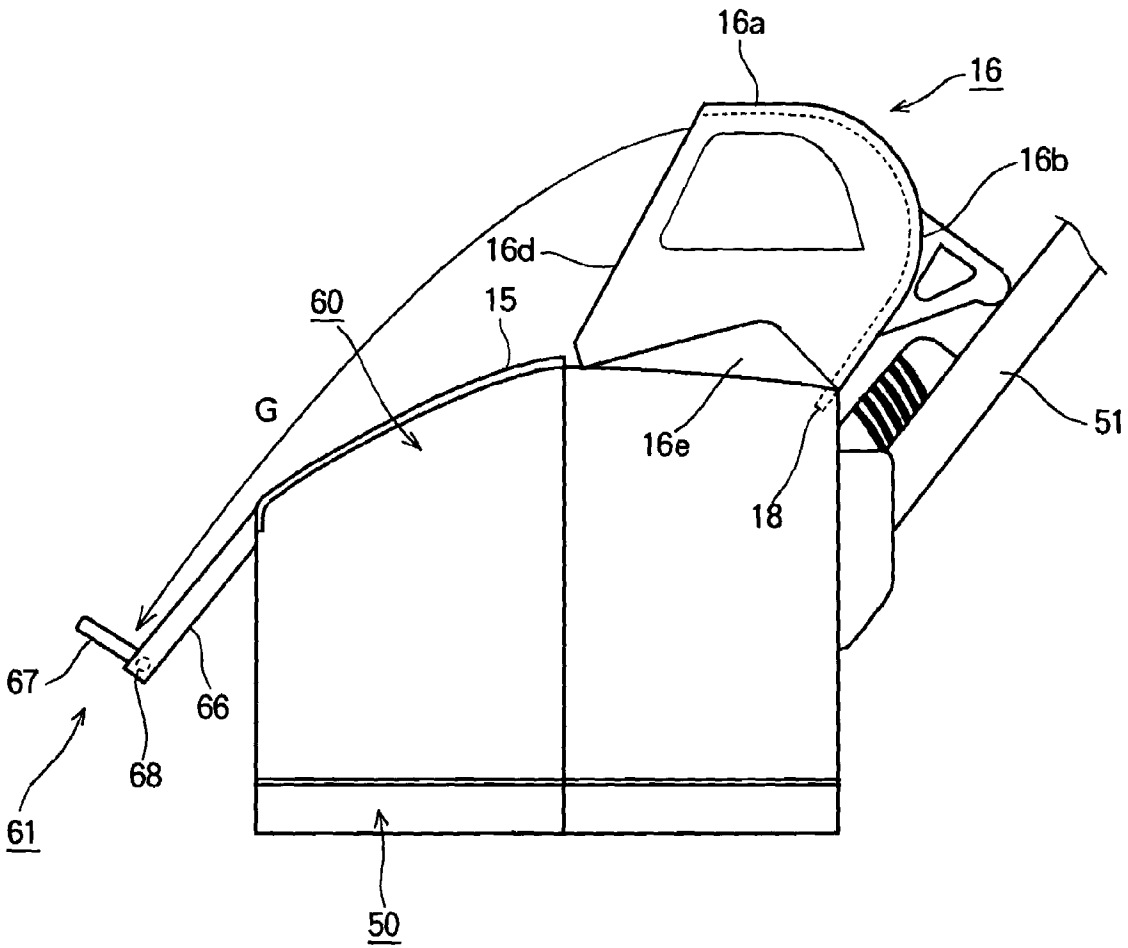
FIG. 11 is a side elevational view of the printer in FIG. 10, showing how the printed pages are delivered face-down.

When the stacker 61 is withdrawn, the surface of the media shelf 66 becomes an extension of the top cover 15, as shown in FIG. 11. If the media turnover guide 16 is in the first position, printed media fed out from the delivery unit 11 encounter the projection 18 and enter the media turnover guide 16 through the entrance opening 16*e*. Guided by the back wall 16*b* and roof 16*a*, the media are delivered from the exit opening 16*d* in the direction indicated by arrow G, with the printed side facing down, and are stacked on the media shelf 66.

The withdrawable stacker 61 housed below the top cover 15 does not affect the appearance of the printer in the fourth embodiment. The stacker housing 60 may be integral with the main body 50, in which case neither the outer dimensions of the printer nor the number of parts is increased.

Figure 12:
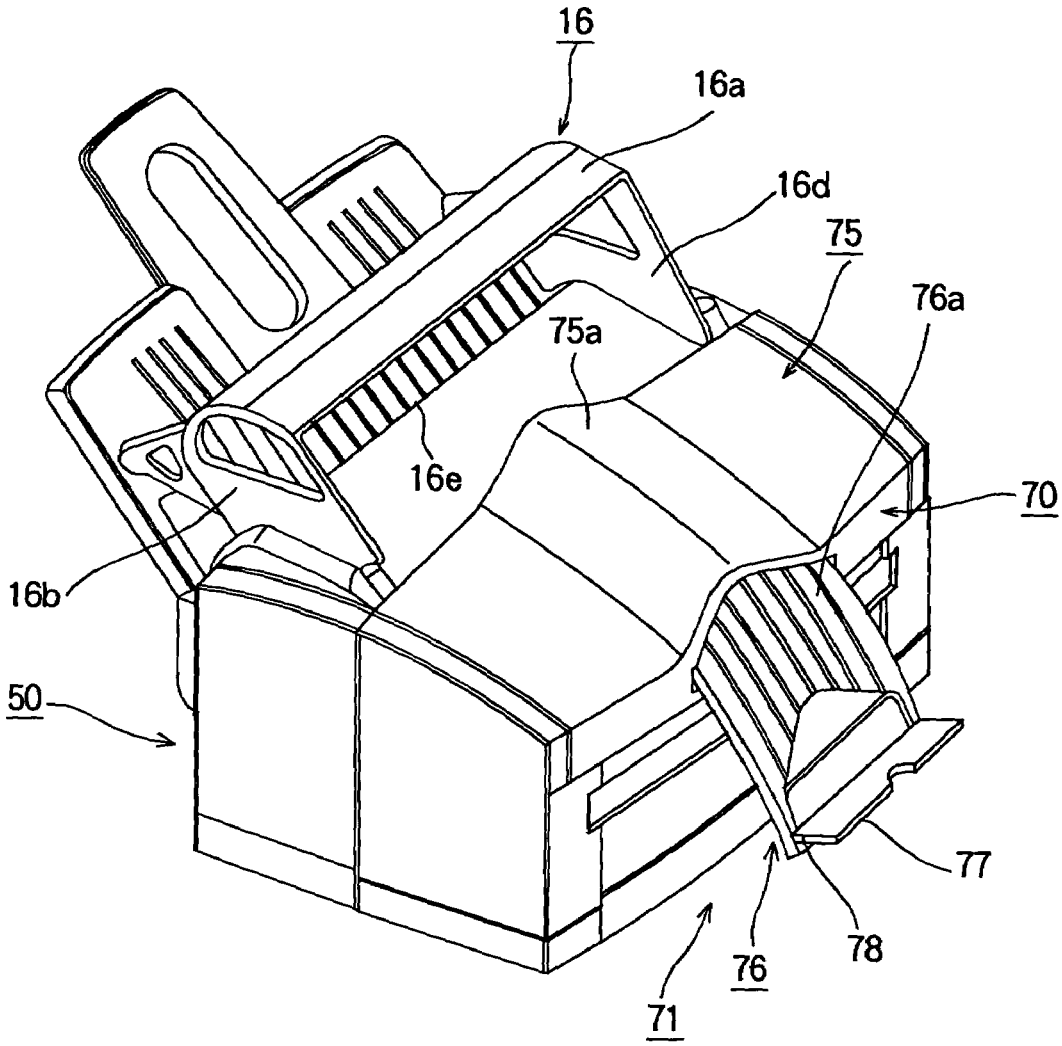
FIG. 12 is a perspective view of a printer according to a fifth embodiment of the invention.
Figure 13:
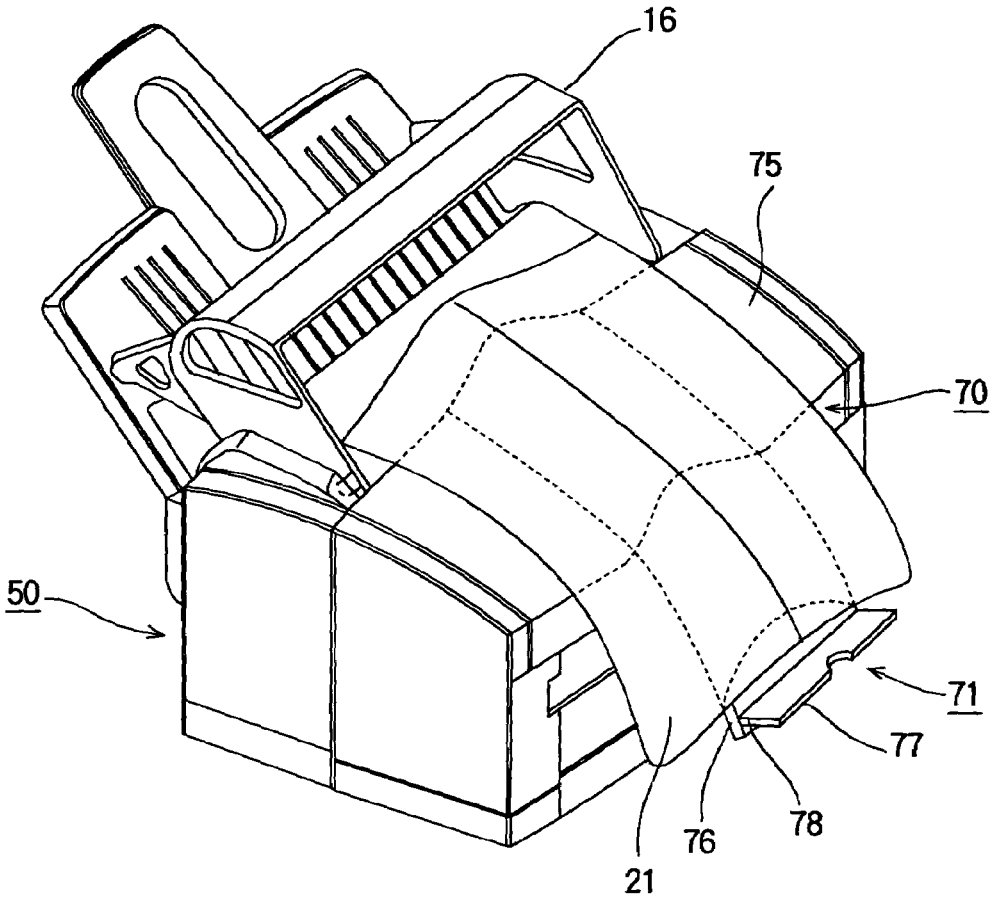
FIG. 13 illustrates media delivery by the printer in FIG. 12.

A fifth embodiment of the invention, illustrated in FIGS. 12 and 13, prevents the media stacked in the face-down mode from curling.

A stacker housing 70 containing a withdrawable stacker 71 is provided under the top cover 75 of the main body 50. The stacker 71 comprises a media shelf 76 and a media stopper 77, which is tiltably attached to the edge of the media shelf 76 by pins 78. The top cover 75 has a hump or ridge 75*a* extending longitudinally in the direction in which the printed media are delivered. The media shelf 76 has a similarly shaped hump 76*a*.

When the media turnover guide 16 is in the first position, if the stacker 71 is withdrawn, the surface of the media shelf 76 becomes an extension of the hump 75*a*. The printed media 21 fed out from the delivery unit 11 encounter the projection 18 and enter the media turnover guide 16 through the entrance opening 16e. Guided by the back wall 16*b* and roof 16*a*, the media are delivered from the exit opening 16*d* onto the hump 75*a* of the top cover 75, with the printed side facing down, and stacked on the hump 76*a* of the media shelf 76 as shown in FIG. 13.

If the media 21 output from the exit opening 16*d* are curled transversely, the humps 75*a*, 76*a* force the media to curl in a direction orthogonal to the transversal direction, so that the transversal curl is flattened out.

The invention is not limited to the embodiments described above. Those skilled in the art will recognize that further variations are possible within the scope of the invention, which is defined in the appended claims.

What is claimed is:

1. A printer comprising:

a main body having a front, a back, top cover and a ridge extending generally upwardly from the top cover;

a back delivery unit mounted on the back of the main body for receiving printed media face-up; and a media turnover guide having a curved surface that turns the printed media over and guides the printed media face-down onto an external surface of the top cover and ridge of the main body, wherein the ridge extends longitudinally in a direction in which the printed media are delivered from the media turnover guide.

2. A printer comprising:

a main body having a front, a back, and a top cover;

a back delivery unit mounted on the back of the main body for receiving printed media face-up; and a media turnover guide having a roof and a back wall, the roof and the back wall joining to form a curved surface that guides the printed media face-down onto the top cover of the main body.

3. The printer of claim 2, wherein the media turnover guide also has a pair of side walls, an entrance opening adjacent the back wall and side walls, and an exit opening adjacent the roof and side walls.

4. The printer of claim 3, wherein the back wall has a projection extending beyond the entrance opening to guide the printed media into the media turnover guide.

5. A printer comprising:

a main body having a front, a back, and a top cover;

a back delivery unit mounted on the back of the main body for receiving printed media face-up; and a media turnover guide having a curved surface that guides the printed media face-down onto the top cover of the main body, the media turnover guide being tiltably attached to the main body, the printed media being guided onto the top cover of the main body when the media turnover guide is tilted to a first position, the printed media being delivered to the back delivery unit when the media turnover guide is tilted to a second position.

6. A printer comprising:

a main body having a front, a back, and a top cover;

a back delivery unit mounted on the back of the main body for receiving printed media face-up; and a media turnover guide having a curved surface that guides the printed media face-down onto the, top cover of the main body, the media turnover guide being detachably mounted on the main body, the printed media being guided onto the top cover of the main body when the media turnover guide is mounted, the printed media being delivered to the back delivery unit when the media turnover guide is detached.

7. A printer comprising:

a main body having a front, a back, and a top cover;

a back delivery unit mounted on the back of the main body for receiving printed media face-up; and a media turnover guide having a curved surface that guides the printed media face-down onto the top cover of the main body, wherein the top cover slopes downward from the back of the main body to the front of the main body, and the media turnover guide has a stacker that rests at least partly on the top cover for stacking the pages delivered onto the top cover.

8. A printer comprising:

a main body having a front, a back, a top cover, and a withdrawable stacker for stacking printed media delivered onto the top cover;

a back delivery unit mounted on the back of the main body for receiving printed media face-up; and a media turnover guide having a curved surface that guides the printed media face-down onto the top cover of the main body.

9. The printer of claim 8, wherein the stacker includes a member that forms a surface substantially flush with the top cover of the main body.

10. The printer of claim 9, wherein said member is erectable when the stacker is withdrawn from the body, and when erected, forms said surface substantially flush with the top cover of the main body.

11. The printer of claim 9, wherein the stacker is housed adjacent the top cover of the main body.

12. A printer comprising:

a main body having a front, a back, and a top cover;

a back delivery unit mounted on the back of the main body for receiving printed media face-up; and a media turnover guide having a curved surface that guides the printed media face-down onto the top cover of the main body; wherein the top cover of the main body has a hump extending longitudinally in a direction in which the printed media are delivered from the media turnover guide; and the main body includes a withdrawable stacker, housed adjacent the top cover, for stacking the pages delivered onto the top cover, the stacker having a humped member that forms an extension of the hump on the top cover of the main body when the stacker is withdrawn.

13. A printer comprising:

a main body having a front, a back, and a top cover, wherein the top cover of the main body slopes downward from the back of the main body to the front of the main body;

a back delivery unit mounted on the back of the main body for receiving printed media face-up; and a media turnover guide having a curved surface that turns the printed media over and guides the printed media face-down onto an external surface of the top cover on the main body.

14. A printer comprising:

a main body having a front, a back, and a top cover; and a media turnover guide having a curved surface that guides the printed media face-down onto the top of the main body;

wherein the top cover of the main body has a curved surface with different heights in a direction orthogonal to a direction in which the printed media are delivered from the media turnover guide.

15. The printer of claim 14, wherein the top cover includes a withdrawable stacker, housed within the top cover, for stacking the printed media delivered onto the top cover.

16. The printer of claim 15, wherein the stacker has a surface that substantially forms an extension of the curved surface of the top cover of the main body when the stacker is withdrawn.

17. The printer of claim 14, wherein the curved surface is a hump rising above the top cover.

18. The printer of claim 17, wherein the top cover includes a withdrawable stacker, housed with the top cover, for the stacking the printed media delivered onto the top cover.

19. The printer of claim 18, wherein the stacker has a surface that substantially forms an extension of the curved surface of the top cover of the main body when the stacker is withdrawn.

20. A printer comprising:

a main body having a front, a back, and a top cover;

a media turnover guide having a curved surface that guides the printed media face-down onto the top cover of the main body; and a withdrawable stacker movable to a first position, in which the withdrawable stacker is housed in part of the top cover, the printed media being delivered onto said part, and a second position in which the drawable stacker is withdrawn from the top cover to stack the printed media delivered onto the top cover, the printed media sliding from an external surface of the top cover onto the withdrawable stacker.

21. A printer comprising:

a main body having a front, a back, and a top cover;

a media turnover guide having a curved surface that guides the printed media face-down onto the top cover of the main body; and a withdrawable stacker, housed within the top cover, for stacking the pages delivered onto the top cover, wherein the stacker has a surface that substantially forms an extension of a surface of the top cover of the main body when the stacker is withdrawn.

* * * * *